US006372056B1

(12) United States Patent
Kuroda et al.

(10) Patent No.: US 6,372,056 B1
(45) Date of Patent: Apr. 16, 2002

(54) SPRING STEEL SUPERIOR IN WORKABILITY

(75) Inventors: Takeshi Kuroda, Osaka; Nobuhiko Ibaraki; Nao Yoshihara, both of Kobe, all of (JP)

(73) Assignee: Kobe Steel Ltd., Kobe (KR)

( * ) Notice: Subject to any disclaimer, the term of this patent is extended or adjusted under 35 U.S.C. 154(b) by 0 days.

(21) Appl. No.: 09/466,930

(22) Filed: Dec. 20, 1999

(30) Foreign Application Priority Data

Dec. 21, 1998 (JP) ..... 10-363395

(51) Int. Cl.[7] ..... C22C 38/02; C22C 38/04

(52) U.S. Cl. ..... 148/320; 148/332; 148/333; 148/580; 148/595; 148/598

(58) Field of Search ..... 148/332–335, 148/908, 580, 595, 596, 598, 320; 420/91–93, 109–111, 118, 119, 124, 126, 127

(56) References Cited

U.S. PATENT DOCUMENTS

| | | | | |
|---|---|---|---|---|
| 4,284,438 A | * | 8/1981 | Barwick et al. | |
| 4,302,248 A | * | 11/1981 | Kasamatsu et al. | |
| 4,545,227 A | * | 10/1985 | Sudoh et al. | |
| 5,186,768 A | * | 2/1993 | Nomoto et al. | 148/580 |
| 5,286,312 A | * | 2/1994 | Shimotsusa et al. | 148/335 |
| 5,508,002 A | | 4/1996 | Kawaguchi et al. | |
| 5,776,267 A | * | 7/1998 | Nanba et al. | 148/328 |
| 5,846,344 A | * | 12/1998 | Kawaguchi et al. | 148/333 |
| 6,017,641 A | * | 1/2000 | Aoki et al. | |
| 6,206,984 B1 | * | 3/2001 | Inada et al. | 148/333 |

FOREIGN PATENT DOCUMENTS

| | | | |
|---|---|---|---|
| JP | 57-116727 | 7/1982 | |
| JP | 63-118013 | 5/1988 | |
| JP | 3-079719 | 4/1991 | |
| JP | 7-188745 | 7/1995 | |
| JP | 8-311547 | 11/1996 | |
| JP | 410251795 A * | 9/1998 | ..... C22C/38/00 |
| WO | WO-99/24630 A * | 5/1999 | |

OTHER PUBLICATIONS

Harcourt Academic Press Dictionary of Science and Technology, http://www.harcourt.com/dictionary/def/5/9/2/4/592400.html, accessed Mar. 19, 2001.*

Patent Abstracts of Japan, vol. 1997, No. 03, Mar. 31, 1997, JP 08 295931, Nov. 12, 1996.

V. T. Mikhailets, et al., Steel in the USSR, vol. 20, No. 7, pp. 347–349, "Optimisation of Technology for Manufacturing Spring Wire of 60S2KHA–SH Steel", Jul. 1, 1990.

V. K. Likhov, et al., Steel in the USSR, vol. 18, No. 2, pp. 81–83, "Assimilation of Production of Wire Rod for Manufacture of Safety Critical Springs", Feb. 1988.

* cited by examiner

*Primary Examiner*—Roy King
*Assistant Examiner*—Harry D. Wilkins, III
(74) *Attorney, Agent, or Firm*—Oblon, Spivak, McClelland, Maier & Neustadt, P.C.

(57) ABSTRACT

A spring steel which is superior in both shaving properties and green drawing properties, which are important in spring production. A process for making the spring steel into wire rods for good springs. A rolled spring steel superior in workability characterized in that it has the following mechanical properties.

Tensile strength≦1200 MPa

30%≦reduction of area≦70%

A process for producing a steel wire rod for springs from said spring steel, said process comprising drawing, shaving, and oil tempering, which are carried out sequentially, said drawing being optionally followed by prescribed treatment.

15 Claims, 1 Drawing Sheet

SPRING STEEL SUPERIOR IN WORKABILITY

BACKGROUND OF THE INVENTION

1. Field of the Invention

The present invention relates to a spring steel to be made into springs as automotive parts in engines, clutches, fuel injectors, suspension systems, etc. The present invention relates also to a process for producing steel wire rods for springs from said spring steel.

2. Description of the Related Art

Wires for springs in various uses as mentioned above are produced by drawing which usually follows shaving (to remove surface defects, such as flaws and decarburized layer, of rolled wire rods) and refining by lead patenting.

In pursuit of higher productivity, attempts are being made to increase the drawing speed. However, drawing at high speeds excessively increases loads on the shaving tool or chipper to damage it and results in incomplete shaving because of inadequate chip removal. There is a demand for a high-strength spring steel which does not present such drawbacks at the time of shaving.

One way to address the problem is by low temperature annealing which is intended to reduce the strength of steel. However, the problem still remains unsolved. Solutions to the problem need knowledge about the metallurgical structure and mechanical properties of the steel to be shaved. Such knowledge has never been sought, however. Meanwhile, in the case where very high fatigue strength is not required, rolled wire rods are drawn into wires directly without being shaved. (Drawing in this way is referred to as green drawing.) Wire rods for this purpose are produced by any of several ways disclosed in Japanese Patent Laid-open Nos. 116727/19982, 118013/19985, and 79719/1991.

New technologies for spring production have been proposed which supersede lead patenting that follows shaving. They include (A) heating at 450–750° C. for a short time just enough to soften the hard surface layer, as disclosed in Japanese Patent Laid-open No. 188745/1995, and (B) heating in a gas phase at a temperature (T) of 823–973 K for a prescribed period of time (t minutes) such that $T\times\sqrt{t}=6700–12000$ ($K\cdot min^{1/2}$), as disclosed in Japanese Patent Laid-open No. 311547/1996. Heat treatment in these manners leaves the as-rolled structure almost intact. Under these circumstances, spring steels are required to have good shaving properties as well as ability for green drawing from wire rods having the as-rolled structure.

Such technical requirements force wire producers to be ready for drawing regardless of whether shaving is carried out or not. Conventional technologies do not provide spring steels capable of both shaving and green drawing, and no attention has been paid to such products.

OBJECT AND SUMMARY OF THE INVENTION

The present invention was completed in order to tackle the above-mentioned problems. It is an object of the present invention to provide a spring steel which has both good shaving properties and capability of green drawing, which are important in the production of springs. It is another object of the present invention to provide a process for producing wire rods for good springs from said spring steel.

The gist of the present invention resides in a spring steel having the following mechanical properties in its as-rolled state before shaving, said spring steel being optionally softened under the following conditions after rolling.

Mechanical Properties

Tensile strength (maximum)≦1200 MPa

30% (minimum)≦reduction of area≦70% (maximum)

Low Temperature Annealing Conditions

Heating in a gas phase at a temperature (T) of 873–1023 K for a prescribed period of time (t minutes) such that $T\times\sqrt{t}=7300\sim15000$ ($K\sqrt{min}^{1/2}$).

In addition, the spring steel according to the present invention should preferably meet the following conditions.

(1) It is composed of pearlite alone or ferrite and pearlite together and has a structure such that the fraction of supercooled structure is less than 10%.

(2) It has a Vickers hardness in the plane of its cross-section whose standard deviation ($\sigma$) is smaller than 20.

(3) It has a Vickers hardness in the plane of its cross-section which is smaller than 380.

The gist of the present invention resides also in a process for producing wire rods for springs from said spring steel, said process comprising drawing, shaving, and oil tempering, which are carried out sequentially, or comprising drawing, shaving, any of the following treatments (a) to (c), and oil tempering, which are carried out sequentially.

(a) Lead patenting treatment.

(b) Heat treatment in a gas phase at a temperature (T) of 823–973 K for a period (t minutes) such that $T\times\sqrt{t}=6700\sim12000$ ($K\cdot min^{1/2}$).

(c) Heat treatment at 450–750° C. for a short time just enough to soften the surface hard layer.

DESCRIPTION OF THE PREFERRED EMBODIMENTS

Figure 1:
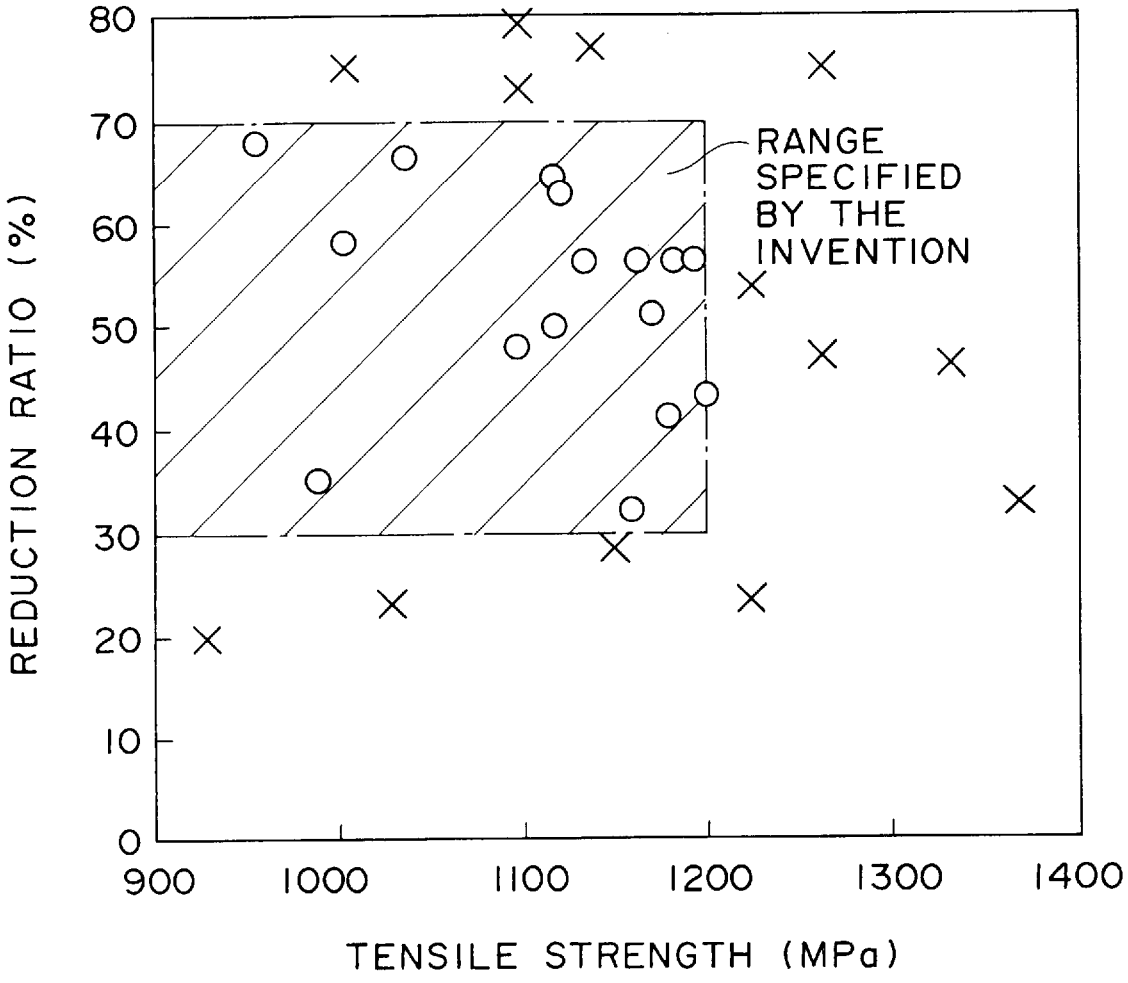
FIG. 1 is a graph showing how the spring steel depends for its workability on its mechanical properties (tensile strength and reduction of area).

The present inventors carried out a series of researches in order to address the above-mentioned problems. As the result, it was found that the object is achieved if the mechanical properties of the spring steel are adequately controlled after rolling or low temperature annealing. The present invention is based on this finding. The following is a detailed description of the requirements of the present invention.

According to the present invention, the spring steel should have mechanical properties (tensile strength and reduction of area) in an adequate range for reasons given below.

The shaving of rolled wire rods often breaks the chipper due to excessive loads on it when the feed speed is too high or when the material strength is too high. The result is incomplete shaving or undesirable streaking on drawn wires. In order to avoid this trouble, it is necessary to soften the steel rod to be shaved to such an extent that its tensile strength is lower than 1200 MPa.

Wire rods are subject to breakage during drawing if they have an excessively high tensile strength. Breakage starts from a site where there exists very hard supercooled structure of martensite or bainite. In order to avoid this trouble, it is necessary to reduce the tensile strength below 1200 MPa, preferably below 1100 MPa. The tensile strength has no specifically restricted lower limit; however, it should be higher than 900 MPa from the standpoint of disposing of chips during shaving.

One factor that affects the shaving performance is the removal of shaved chips. Chips which do not break easily stay near the chipper and entangle themselves with the wire rod being shaved. Thus, chips prevent uniform shaving. In order to permit chips to be broken and removed easily, it is necessary to adequately limit the toughness and ductility of the steel. For this reason, the present invention requires that the spring steel have a reduction of area (as an indication of ductility) lower than 70%, preferably lower than 60% (maximum).

The wire rod is subject to breakage even though it has a low tensile strength if it contains coarse pearlite (structure with large lamellar spacing), which is poor in toughness and ductility and permits chevron cracks to occur. For this reason, adequate toughness and ductility are necessary. Thus, the present invention requires that the spring steel have a reduction of area (as an indication of ductility) higher than 40%.

The above-mentioned tensile strength and reduction of area are those of as-rolled wire rods. If wire rods do not have the specified values, they may be annealed after rolling so that they can be used effectively.

According to the present invention, this low temperature annealing should be carried out at a temperature (T) of 873–1023 K for a prescribed period of time (t minutes) such that $T\times\sqrt{t}=7300\sim15000$ ($K\cdot min^{1/2}$) for the reasons given below.

Annealing at high temperatures gives rise to globular cementite in a wire rod, causing chevron cracks to occur at the center of a drawn wire. A drawn wire with chevron cracks is liable to break as the reduction of area increases. Even though the annealing temperature is comparatively low for no globular cementite to appear, breakage may occur during drawing due to insufficient ductility. In other words, annealing at a comparatively low temperature permits the rolled structure to remain even after heat treatment. Therefore, rolled wire rods composed mainly of coarse pearlite poor in ductility are subject to chevron cracks leading to breakage during drawing that follows annealing.

Wire rods with chevron cracks may not break during drawing, but wires drawn from them may break when formed into springs. On the basis of this finding, the present inventors sought the condition required to smoothly perform drawing and coiling without causing breakage. As the result, they finally established the above-mentioned equation to define the relation between the temperature for heat treatment following rolling and the length of heating time.

Incidentally, the term "reduction of area" as used in this specification is defined as follows.

$$\text{Reduction of area } (\%)=(A-A')/A\times100$$

(where A is the sectional area of the test piece for tensile test, and A' is the sectional area of the test piece which has been broken after tensile test.)

Wire rods with controlled mechanical properties as mentioned above are satisfactory in shaving and green drawing properties as illustrated in FIG. 1, which is a graph showing how the spring steel depends for its workability on its mechanical properties (tensile strength and reduction of area). In FIG. 1, marks of ○ represent those wire rods which are superior in both drawability and shaving performance, and marks of x represent those wire rods which lack either or both of the above-mentioned workability. (Criteria for evaluation will be explained in Examples given later.) In FIG. 1, the maximum value of tensile strength is plotted for each sample, and the maximum or minimum value of reduction of area is plotted for each sample.

The present inventor's further studies indicate that the spring steel with the above-mentioned characteristics can be produced stably if the following requirements are met.

The wire rod should have a Vickers hardness on its cross-section whose standard deviation (σ) is smaller than 20, preferably smaller than 15. This requirement was set on the basis of the finding that green drawing is affected if microstructure in the cross-section varies. This finding suggests the necessity of controlling variation of hardness in the plane of cross-section. In other words, a wire rod whose Vickers hardness greatly varies in the plane of cross-section is liable to breakage under severe production conditions (due to uneven deformation in the cross-section) and is also liable to chevron cracks which cause breakage during spring forming. It is understood that one way to prevent breakage is to reduce hardness variation.

The wire rod should have a Vickers hardness in the plane of its cross-section which is smaller than 380, preferably smaller than 370. The wire rod will not be shaved as much as necessary if it has unevenly strong parts which apply an excessive load on the chipper, increasing its wear and expanding its diameter. The above-mentioned tensile strength represents that of the entire cross-section of the wire rod but does not represent that which partly varies in the cross-section of the wire rod. The present inventors found that the Vickers hardness measured in the plane of cross-section indicates the partial variation of strength in the plane of cross-section. Thus, the present invention specifies not only tensile strength but also Vickers hardness as mentioned above.

Meanwhile, if there exists supercooled structure such as martensite and bainite, hardness decreases due to low temperature annealing, with drawability improving to a certain extent. Although the supercooled structure which has been softened by low temperature annealing is similar to pearlite structure in hardness, it still differs from it in deformability due to drawing. Therefore, the wire rod is subject to breakage under very severe drawing conditions and the drawn wire is liable to chevron cracks (leading to breakage) at the time of spring forming.

The above-mentioned problem arises less as the fraction of supercooled structure decreases. It was found that the fraction should preferably be lower than 10%, preferably lower than 5%, so that the structure is composed substantially of pearlite alone or in combination with ferrite.

In the present invention, hardness and microstructure are measured by the following methods. Hardness is measured according to JIS Z2244 (Vickers hardness). Measurements are carried out at four or more locations in each sectional area within D/16, D/8, and D/4 and at 13 or more locations in the sectional area within D/2 of the wire rod (D standing for the diameter of the wire rod). Microstructure: The cross section of the wire rod is observed under an optical microscope and the ratio of area of supercooled structure is measured (preferably by using an image analysis device).

There are no specific restrictions on the kind of wire rod to which the present invention is applied. Examples of the wire rod include SWOSC-V specified in JIS G3522, G3560, and G3561 which is made into spring wires by shaving and drawing.

The spring steel according to the present invention may have any chemical composition so long as it leads to good mechanical properties (tensile strength, elongation, and reduction of area) and good drawability (without excessive work hardening). Typical examples of the chemical composition (in mass %) are given below.

C: 0.38–0.85%, Si: 0.25–2.10%, Mn: 0.2–1.0%, P<0.035%, S<0.035%, at least one optional component (less than 2.5% in total) selected from Cr: 0.65–1.5%, Mo: 0.1–0.5%, V: 0.05–0.50%, Ni: 0.2–0.5%, Nb: 0.02–0.50%, Ti: 0.02–0.09%, and Cu: 0.10–0.30%, with the remainder being iron and inevitable impurities. The composition may contain additional elements to meet specific requirements.

The spring steel meeting the requirements of the present invention may be obtained in any manner which is not specifically restricted. For example, it may be obtained from a steel whose segregation is such that the ratio of $C_{max}/C_0$ (maximum value/ladle value) is lower than 1.2. This steel should be hot-rolled in such a way that the temperature after finishing rolling (just before being laid on the conveyor) is lower than 850° C. After laid on the conveyor, the resulting wire rod should be cooled at a rate of 1–4° C./sec in the range from Ps point+15° C. to Pf point−15° C. (Ps point is the temperature at which pearlite transformation starts, and Pf is the temperature at which pearlite transformation ends.) The rolled wire rod should be annealed at 570–690° C. for 2–3 hours, if low temperature annealing is necessary.

It was found that the spring steel according to the present invention can be readily made into wire rods for springs by drawing and ensuing oil tempering, with or without any of the following treatments between drawing and oil tempering.

(a) Shaving and ensuing lead patenting.

(b) Shaving and ensuing heat treatment in a gas phase at a temperature (T) of 823–973° C. for a period of time (t minutes) such that $T\times\sqrt{t}=6700\sim12000$ ($K\cdot min^{1/2}$).

(c) Shaving and ensuing heat treatment at 450–750° C. for a short period of time just enough to soften the surface hard layer.

The oil-tempered wire passed the windability test in which D/d=2 (where D is the average diameter of the spring and d is the diameter of the wire). This result suggests that the spring steel has good windability.

EXAMPLE

The invention will be described in more detail with reference to the following example, which is not intended to restrict the scope thereof. Various changes and modifications may be made in it without departing from the scope and spirit of the invention.

An Si—Cr spring steel having the chemical composition shown in Table 1 and conforming to JIS SUP12 was rolled into a wire rod (8.0 mm in diameter).

TABLE 1

| Chemical composition (mass %) | | | | | |
|---|---|---|---|---|---|
| C | Si | Mn | P | S | Cr |
| 0.57 | 1.47 | 0.71 | 0.011 | 0.009 | 0.70 |

The spring steel has segregation such that the ratio of $C_{max}/C_0$ is 1.0~1.5. The rolling was carried out in such a way that the temperature after rolling and just before being laid on the conveyor was 800–1050° C. The wire was cooled at a rate of 0.1–10° C./sec. The resulting wire rod was annealed at different temperatures ranging from 600 to 700° C. for different periods of time ranging from 2 to 5 hours so that it has varied characteristic properties. Annealing was also carried out in a gas phase at 550–700° C. for different periods of time.

The thus obtained wire rod was cut and the cross-section (embedded) was polished. The polished surface was measured for Vickers hardness at locations specified above. (4 locations in each sectional area within D/16, D/8, and D/4 and at 13 locations in the sectional area within D/2, with D standing for the diameter of the wire rod). After etching, the polished surface was observed under an optical microscope to examine its microstructure. The fraction of microstructure was calculated by image analysis.

To examine mechanical properties, the wire rod was cut into 100 test pieces, each measuring about 30 cm long, and they were tested for tensile strength (with a tensile tester) and reduction of area.

After pickling and zinc phosphate treatment, the wire rod was examined for shaving properties and drawability as follows.

Shaving was carried out by using a D1 die 7.7 mm in diameter and a chipper 7.4 mm in diameter. The drawing speed was 80 m/min. (This drawing speed, which is higher than the ordinary one of 50–70 m/min, was selected so as to emphasize the effect of the invention. At such a high drawing speed, the chipper is liable to breaking.) The specimens capable of drawing at a speed of 80 m/min were subsequently drawn at a higher speed of 100 m/min so as to further emphasize the effect of the invention.

Drawability was evaluated by using a drawing die with an approach angle of 20°. (This approach angle, which is greater than the ordinary one of about 12°, was selected so as to emphasize the effect of the invention. With such a great approach angle, the drawing die is liable to cause a cuppy breakage.) The specimens capable of drawing through these dies were subsequently drawn through dies with an exceptionally great approach angle of 30° so as to further emphasize the effect of the invention. This approach angle is not usually used in the industry.

Those wires (3.35 mm in diameter) drawn under the above-mentioned conditions underwent oil tempering. The resulting wires had a strength of 1950 MPa. They were examined for windability (D/d=2) to confirm the effect of the present invention. Table 2 shows the mechanical properties of the spring steel, and Table 3 shows the results of evaluation. Marks in Table 3 represent the following criteria.

Shaving Properties

○: no problem

Δ: no problem except for a slight increase in diameter x: breaking of chipper

Drawability

○: capable of drawing with a reduction of area higher than 80% x: breaking

Windability

○: no breakage x: breakage

TABLE 2

| Code | Tensile strength (MPa: maximum) | Reduction of area (%) Minimum | Reduction of area (%) Maximum | Vickers hardness (Hv) Max | Vickers hardness (Hv) σ | Fraction of supercooled structure (%) | Major structure | Annealed |
|---|---|---|---|---|---|---|---|---|
| A-1 | 1175 | 41 | 56 | 370 | 5.5 | 0 | ferrite + pearlite | no |
| A-2 | 1155 | 56 | 67 | 365 | 3.0 | 0 | pearlite | no |
| B-1 | 1090 | 48 | 63 | 345 | 6.0 | 15 | pearlite | yes |
| B-2 | 1110 | 49 | 58 | 340 | 3.8 | 6 | pearlite | yes |
| B-3 | 1180 | 56 | 66 | 390 | 16.0 | 0 | pearlite | no |
| B-4 | 1165 | 51 | 65 | 355 | 28 | 0 | pearlite | no |

TABLE 2-continued

| Code | Tensile strength (MPa: maximum) | Reduction of area (%) Minimum | Reduction of area (%) Maximum | Vickers hardness (Hv) Max | Vickers hardness (Hv) σ | Fraction of supercooled structure (%) | Major structure | Annealed |
|---|---|---|---|---|---|---|---|---|
| B-5 | 1195 | 43 | 62 | 405 | 23 | 3 | pearlite | no |
| B-6 | 1155 | 32 | 56 | 375 | 14.0 | 0 | ferrite + pearlite | no |
| C-1 | 1325 | 46 | 59 | 410 | 8.0 | 0 | ferrite + pearlite | no |
| C-2 | 1255 | 47 | 60 | 395 | 12.0 | 0 | ferrite + pearlite | no |
| C-3 | 1145 | 28 | 47 | 355 | 18.0 | 0 | coarse pearlite | no |
| C-4 | 1085 | 57 | 77 | 335 | 14.0 | 0 | pearlite | no |
| C-5 | 1955 | 0 | 0 | 610 | 2.5 | 100 | martensite | no |

TABLE 3

| Code | Shaving properties Drawing speed (m/min) 80 | Shaving properties Drawing speed (m/min) 100 | Drawability Die (20°) | Drawability Windability | Drawability Die (30°) | Drawability Windability |
|---|---|---|---|---|---|---|
| A-1 | ○ | ○ | ○ | ○ | ○ | ○ |
| A-2 | ○ | ○ | ○ | ○ | ○ | ○ |
| B-1 | ○ | ○ | ○ | ○ | ○ | — |
| B-2 | ○ | ○ | ○ | ○ | ○ | X |
| B-3 | ○ | Δ | ○ | ○ | ○ | ○ |
| B-4 | ○ | ○ | ○ | ○ | ○ | X |
| B-5 | ○ | Δ | ○ | ○ | ○ | X |
| B-6 | ○ | ○ | ○ | ○ | ○ | — |
| C-1 | X | — | X | — | — | — |
| C-2 | X | — | ○ | X | — | — |
| C-3 | ○ | ○ | X | — | — | — |
| C-4 | ○ | X | ○ | ○ | ○ | ○ |
| C-5 | X | — | X | — | — | — |

Tables 2 and 3 suggest as follows regarding the shaving properties. Comparative samples (C-1, C-2, and C-5) with high tensile strength broke the chipper when their drawing speed was 80 m/min. Comparative sample (C-4) at a drawing speed of 100 m/min caused chips to entangle themselves with the chipper. (The entangled chips pressed the wire rod against the chipper, resulting in uneven shaving.) Samples B-3 and B-5 posed no problems at the time of shaving; however, they increased in diameter by 0.05 mm at the start and end of shaving. Other samples posed no problems, with an increase in diameter by less than 0.02 mm.

Tables 2 and 3 also suggest as follows regarding the drawability. Comparative samples (C-1, C-3, and C-5) with high tensile strength or low reduction of area suffered cuppy breakage when drawn through a die with an approach angle of 20°. Other samples were drawn so that their diameter was reduced to 3.35 mm. After oil tempering, the wires underwent windability test. The wire made from C-2 suffered cuppy breakage.

Samples (A-1, A-2, B-1 to B-6, and C-4) were found to be superior in drawability. They were drawn through a die with an approach angle of 30° to confirm the effect of the invention. Samples B-1 and B-6 suffered cuppy breakage before the reduction of area exceeded 80%. After oil tempering, the wires made from A-1, A-2, B-2 to B-5 underwent windability test. The wires made from B-2, B-4, and B-5 suffered cuppy breakage.

The foregoing results suggest that the requirement for both good shaving properties and drawability is met only when the spring steel has the characteristic properties of A-1, A-2, and B-1 to B-6. In addition, the spring steel should have the characteristic properties of A-1 and A-2 if it is to be processed stably under any conditions.

The spring steel of the same composition as mentioned above was made into several kinds of wire rods (with high tensile strength) under varied rolling conditions as shown in Table 4. These wire rods were softened under different conditions so that they had varied tensile strength. Then, they were drawn, with the reduction of area varied, and the drawn wires were examined for shaving properties and physical properties. The results are shown in Table 4.

TABLE 4

| Code | Wire rod as-rolled: Tensile strength (MPa. Max) | Wire rod as-rolled: Reduction of area (%) Min. | Wire rod as-rolled: Reduction of area (%) Max. | Wire rod after annealing: Annealing temperature T (K) | Wire rod after annealing: Annealing time t (min) | Wire rod after annealing: T × √t | Wire rod after annealing: Tensile strength (Pa) max | Wire rod after annealing: Reduction of area (%) Min. | Wire rod after annealing: Reduction of area (%) Max. | Wire rod after annealing: Vickers hardness (HV) max. | Shaving properties drawing speed (m/min) 80 | Shaving properties drawing speed (m/min) 100 |
|---|---|---|---|---|---|---|---|---|---|---|---|---|
| 1 | 1300 | 10 | 21 | 790 | 120 | 8654 | 1251 | 14 | 41 | 454 | X | — |
| 2 | 1220 | 20 | 45 | 1100 | 120 | 12050 | 862 | 35 | 61 | 242 | ○ | X |
| 3 | 1350 | 10 | 19 | 1000 | 50 | 7071 | 1246 | 27 | 44 | 403 | X | — |
| 4 | 1280 | 21 | 38 | 970 | 160 | 12270 | 876 | 55 | 64 | 238 | ○ | X |
| 5 | 1210 | 28 | 41 | 830 | 120 | 9092 | 955 | 47 | 65 | 259 | ○ | ○ |
| 6 | 1200 | 24 | 45 | 900 | 120 | 9859 | 857 | 52 | 70 | 223 | ○ | X |
| 7 | 1400 | 9 | 16 | 950 | 100 | 9500 | 1180 | 36 | 55 | 365 | ○ | ○ |
| 8 | 1550 | 8 | 15 | 970 | 160 | 11880 | 1280 | 11 | 28 | 360 | X | — |
| 9 | 1330 | 12 | 19 | 950 | 100 | 9500 | 1100 | 56 | 78 | 267 | ○ | X |
| 10 | 1330 | 15 | 22 | 950 | 100 | 9500 | 1100 | 48 | 63 | 403 | ○ | X |

Table 4 shows the results of experiments with the wire rods which were obtained by rolling billets (155×155 mm) into wire rods (8.0 mm in diameter) with high tensile strength. The wire rods were annealed to reduce its tensile strength and increase its reduction of area. It is noted from Table 4 that even those wire rods with high tensile strength and low reduction of area in their as-rolled state exhibit good shaving properties if they are annealed under adequate conditions so as to impart adequate tensile strength and reduction of area to them. This holds true particularly with the annealed wire rods of code Nos. 5 and 7.

[Effect of the invention] As mentioned above, the present invention provides a spring steel which is superior in both shaving properties and green drawing properties, which are important in spring production. This spring steel can be processed into wire rods for springs under the prescribed conditions.

What is claimed is:

1. A rolled spring steel comprising an as-rolled steel wire rod having E≦1200 MPa, the E being a tensile strength, 30%≦RA≦70%, the RA being a reduction of area, σHv<20, the σHv being a standard deviation of a Vickers hardness in a plane of a cross-section of the as-rolled steel wire rod.

2. A rolled spring steel according to claim 1, wherein the as-rolled steel wire rod contains in mass %:

0.38–0.85% C;

0.25–2.10% Si;

0.2–1.0% Mn;

0.035%>P;

0.035%>S; and at least one optional component selected from the group consisting of 0.65–1.5% Cr, 0.1–0.5% Mo, 0.05–0.50% V, 0.2–0.5% Ni, 0.02–0.50% Nb, 0.02–0.09% Ti, and 0.10–0.30% Cu; wherein:

a total percent of said at least one optional component is less than 2.5%.

3. The rolled spring steel as defined in claim 2, wherein said as-rolled steel wire rod has Hv≦380, the Hv being a Vickers hardness in a plane of a cross-section of said as-rolled wire rod.

4. The rolled spring steel as defined in claim 1, wherein said rolled spring steel consists essentially of one of a pearlite structure and a combination of ferrite and pearlite structures, and has a fraction of supercooled structure less than 10%.

5. The rolled spring steel as defined in claim 1, wherein said rolled spring steel consists essentially of ferrite and pearlite, and has a fraction of supercooled structure less than 10%.

6. A rolled spring steel as defined in claim 1, wherein said as-rolled steel wire rod has Hv<380, the Hv being a Vickers hardness in the plane of the cross-section of the as-rolled steel wire rod.

7. A rolled spring steel as defined in claim 1, wherein said as-rolled steel wire rod comprises an as-rolled steel wire rod annealed at a temperature, T, of 873–1023 K for a period of time, t, the T and t satisfying a relationship, $T\times\sqrt{t}=7300\sim12000\ K\cdot min^{1/2}$.

8. A process for producing a wire rod for a spring from a spring steel, said process comprising;

preparing an as-rolled steel wire rod such that said as-rolled steel wire rod has E≦1200 MPa, the E being a tensile strength, and 30%≦RA≦70%, the RA being a reduction of area RA, σHv<20, the σHv being a standard deviation of a Vickers hardness in a plane of a cross-section of said as-rolled wire rod;

drawing said as-rolled steel wire rod to form said wire rod;

shaving said wire rod to remove surface defects therefrom; and oil tempering said wire rod.

9. The process as defined in claim 8, further comprising lead patenting treating performing prior to said oil tempering step and after said shaving step.

10. The process as defined in claim 8, wherein said preparing step comprises heat treating the as-rolled steel wire rod in a gas phase at a temperature, T, of 873–1023 K for a period, t, such that the T and t satisfy a relationship, $T\times\sqrt{t}=7300\sim15000\ K\cdot min^{1/2}$.

11. The process as defined in claim 8, further comprising heat treating at 450–750° C. for a time sufficient to soften a hard surface layer, said heat treating performed prior to said oil tempering step and after said shaving step.

12. A process as defined in claim 8, wherein said preparing step comprises hot-rolling a steel having a $C_{max}/C_0$ ratio lower than 1.2 such that a temperature of said steel after rolling is lower than 850° C., cooling said steel at a rate of 1–4° C./sec in a range from a Ps point+15° C. to a Pf point−15° C., wherein the $C_{max}/C_0$ ratio is a $C_{maximum\ value}/C_{ladle\ value}$, the Ps point is a temperature at which pearlite transformation starts, and the Pfis a temperature at which pearlite transformation ends.

13. A process as defined in claim 12, wherein said preparing step further comprises annealing the steel at 570° C.–690° C. for 2–3 hours.

14. A rolled spring steel produced by the process recited in any one of claims 8–11.

15. A spring produced by a process defined in claim 8.

* * * * *

UNITED STATES PATENT AND TRADEMARK OFFICE

CERTIFICATE OF CORRECTION

PATENT NO. : 6,372,056 B1
DATED : April 16, 2002
INVENTOR(S) : Kuroda et al.

It is certified that error appears in the above-identified patent and that said Letters Patent is hereby corrected as shown below:

Title page,
Item [73], the Assignee should read:
-- [73] Assignee: Kabushiki Kaisha Kobe Seiko Sho, Kobe (JP) --

Signed and Sealed this

Seventeenth Day of September, 2002

*Attest:*

*Attesting Officer*

JAMES E. ROGAN
*Director of the United States Patent and Trademark Office*